US006792724B2

(12) United States Patent
Burgess

(10) Patent No.: US 6,792,724 B2
(45) Date of Patent: Sep. 21, 2004

(54) METHODS OF MAKING WINDOWS AND WINDOWS MADE THEREBY

(76) Inventor: Alan David Burgess, Springbrooks, Grande Road, Wickham Bishops, Essex (GB), CM8 3LT ( * ) Notice: Subject to any disclaimer, the term of this patent is extended or adjusted under 35 U.S.C. 154(b) by 7 days.

(21) Appl. No.: 10/204,329

(22) PCT Filed: Feb. 16, 2001

(86) PCT No.: PCT/GB01/00640

§ 371 (c)(1),
(2), (4) Date: Mar. 4, 2003

(87) PCT Pub. No.: WO01/61136

PCT Pub. Date: Aug. 23, 2001

(65) Prior Publication Data

US 2003/0159374 A1 Aug. 28, 2003

(30) Foreign Application Priority Data

Feb. 19, 2000 (GB) ..... 003813

(51) Int. Cl.[7] ..... E06B 3/964; E06B 3/968

(52) U.S. Cl. ..... 52/204.61; 52/204.53; 52/456; 52/664; 52/668; 49/50

(58) Field of Search ..... 52/204.6, 204.61, 52/456, 5, 16, 204.5, 204.53, 204.54, 214, 204.56, 204.55, 504.57, 204.58, 204.62, 660–667, 668–676; 49/50, 57

(56) References Cited

U.S. PATENT DOCUMENTS 1,658,656 A * 2/1928 Sargent ..... 52/127.1
3,108,336 A * 10/1963 Tate ..... 52/204.61
3,308,593 A * 3/1967 Smith ..... 52/456
3,411,258 A * 11/1968 Milton ..... 52/456
3,474,587 A * 10/1969 Martin ..... 52/456
3,504,468 A * 4/1970 Martin ..... 52/204.61
4,115,973 A * 9/1978 Anderson ..... 52/773
4,376,359 A * 3/1983 Redman ..... 52/127.1
4,671,027 A * 6/1987 Esposito ..... 52/86
4,715,153 A * 12/1987 Rohrman ..... 52/204.55
5,291,710 A * 3/1994 Golen ..... 52/311.1
5,331,727 A * 7/1994 Golen ..... 29/453
5,477,647 A * 12/1995 Yates, Jr. ..... 52/204.57
6,155,010 A * 12/2000 Becken et al. ..... 52/204.61
6,718,704 B2 * 4/2004 Plummer et al. ..... 52/204.61

* cited by examiner

*Primary Examiner*—Jeanette Chapman
(74) *Attorney, Agent, or Firm*—Renner, Kenner, Greive, Bobak, Taylor & Weber

(57) ABSTRACT

A method of providing a glazed panel with Georgian-effect glazing bars (45). The method comprises providing a frame (37) for the panel and glazing material (30) to fit within the frame. A generally U-shaped clip (33), having two arms (35,36) which lie respectively against the side faces of the glazing material, is arranged to extend around the edge of the glazing material (30). A length of moulded hollow-section glazing bar (45), suitable for extending across a side face of the glazing material (30), is cut and is then engaged with an arm (35) of the clip so that the arm enters the open end (49) of the glazing bar (45). This holds the end region of the glazing bar (45) against the side face of the glazing material (30). Preferably a matrix of intersecting glazing bars (45) is formed, and at least some of the ends of the bars that extend to the edge of the panel are held in place by U-shaped clips.

21 Claims, 6 Drawing Sheets

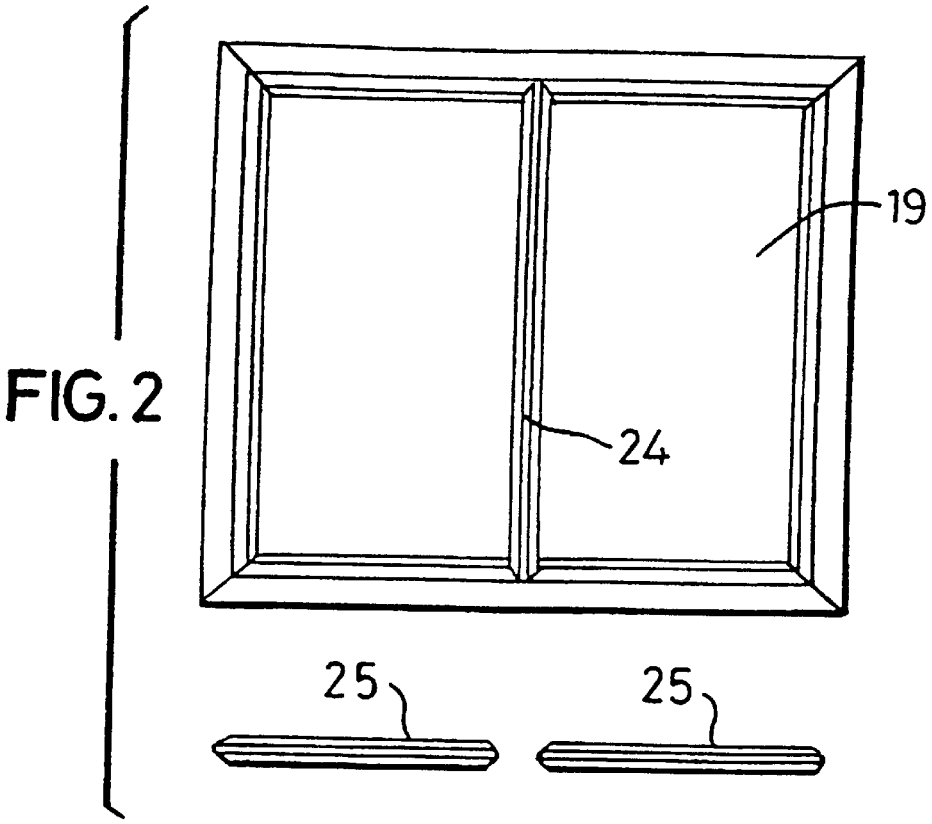
FIG. 2
FIG. 3
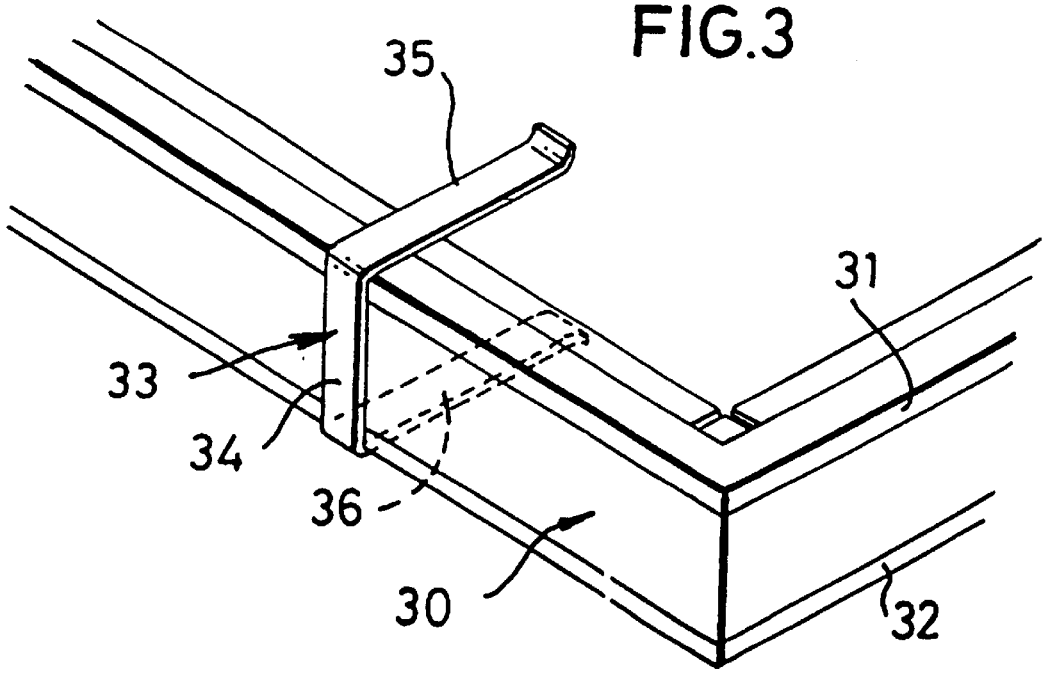

METHODS OF MAKING WINDOWS AND WINDOWS MADE THEREBY

The present invention relates to a method of constructing a window with Georgian style glazing bars thereon, and also to a window constructed by such a method. The invention also relates to clips for use in the construction method.

Previously, when windows were constructed from wood, it was common practice to make windows in a so-called Georgian style with an arrangement of smaller panes attached to a matrix of horizontal and vertical bars, thereby forming an overall larger window. Such constructions were originally adopted due to the fact that production of large panes of glass was either impossible or prohibitively expensive. Nowadays, it is easy to produce large panes of glass, and it is more expensive to produce a window with smaller individual panes as this necessitates a more complex construction and is more labour-intensive, especially when a window is double glazed. However, it is often desirable for aesthetic reasons to simulate the appearance of a Georgian style window, whether it be on a sash, casement or other type.

Previous attempts have been made to simulate a Georgian style on a window made with frame members of modern materials such as aluminium or plastics. To achieve this, glazing bars have been adhered to the surface of a large pane of glass (or double glazing unit) to give the impression that a number of smaller panes make up the window. Often, these bars are provided on both inner and outer surfaces of the window. The bars are adhered to the glass surface using a variety of different adhesives, but this method suffers from a serious drawback. The adhesives used are all subject to degradation and once the adhesive has degraded beyond a certain critical point it is no longer able to hold the glazing bars securely to the glass. Should the glazing bars fall off, this creates an extremely undesirable visual effect. The problem of adhesive degradation is particularly acute on the external face of a window due to repeated exposure to moisture and the elements, but can also be a problem on the internal face.

It is an aim of the present invention to overcome the above mentioned problems and to provide a method of attaching a glazing bar or bars to a window, which glazing bars are much less susceptible to becoming detached from the glass due to degradation of the adhesive.

Therefore according to the present invention there is provided a method of furnishing a glazed panel with at least one Georgian-effect glazing bar, which method comprises the steps of:

- providing a frame for the panel and glazing material to fit within the frame;
- arranging a generally U-shaped clip to extend around an edge of the glazing material, the clip having two arms which lie respectively against the side faces of the glazing material;
- cutting a suitable length of moulded hollow-section glazing bar for extending across a side face of the glazing material, from one frame member to an opposed frame member; and
- engaging an arm of the clip in an open end of the glazing bar, to hold the end region of the glazing bar against the side face of the glazing material.

It is better that the bar is held at both ends thereof and so it is preferred that a second clip is arranged around an opposed edge of the glazing material, the glazing bar extending between the two clips with the respective arms of the two clips engaged in the two open ends of the glazing bar.

To ensure that the connection of the glazing bar to the glazed material is as secure as possible the glazing bar may have a substantially flat face adapted to lie against the glazing material, the substantially flat face being adhered to the underlying glazing material. The adhesion of the glazing bar to the glazing material may be performed by any conventional adhesion method, but it is preferred that the substantially flat face of the glazing bar caries a length of double-sided adhesive tape having an exposed backing sheet, which backing sheet is stripped to expose the adhesive immediately before the glazing bar is adhered to the glazing material.

In the current method the glazing bar may be fitted to the arms of the clip or clips before then being adhere to the glazing material. The backing sheet may be stripped from the bar before or after connection of the bar to the clips, but it is preferred that it is stripped after connection. A glazing bar with sufficient flexibility may be positioned on the arms of the clips without risk of accidental adhesion in an incorrect location, and once the open ends of the bar are located, the backing sheet may be removed and the bar pressed onto the glazing material and so adhered thereto. The flexibility of the bar allows the middle portion thereof to be curved away from the glazing material to permit access to and removal of the backing strip.

In most applications it is preferred that more than one glazing bar is fitted to the glazing material. The glazing bars may intersect substantially at right angles, to form a generally grid-shaped matrix of horizontal and vertical bars that mimics a traditional "Georgian-style" window.

To ensure that the intersections of the glazing bars have the correct visual appearance and structural integrity, a number of suitable methods of forming the intersections may be employed. One way is to form a halved joint at each intersection between the glazing bars. Such a halved joint is formed by cutting away one of the intersecting bars and then cutting the other bar to leave a portion that fits within the cut-out formed in the first bar.

Alternatively the intersections may be formed by leaving one glazing bar continuous, and cutting the other glazing bar so that it overlaps the external surface of the one glazing bead and matches the external profile thereof. The other glazing bar when cut in this way will be discontinuous but both portions are attached to the one glazing bar.

The connection of a discontinuous glazing to the continuous bar may be achieved in a number of ways, but one example is to provide a bridging connector that passes through or under the one continuous glazing bar, and which connector attaches to the two ends of the discontinuous bar that abut the one continuous bar. Such a bridging connector may be configured to extend laterally with respect to the one glazing bar, with the extended portions of the bridging connector locating in open ends of the discontinuous other glazing bar. The open ends have been exposed by the cutting of the other glazing bar to fit against the profile of the one glazing bar.

A resilient glazing bead may be used to hold the glazing material in the frame, and the end portion of the or each glazing bar will overlap the external surface of the glazing bead and is cut to match the external profile thereof.

To create the simulated appearance of a Georgian-style window, it may be preferred that glazing bars are fitted to both sides of the glazing material, in alignment with each other. To achieve this it is convenient that the arms of the U-shaped clip extend on both sides of the glazing material a distance sufficient to allow connection of a glazing bar to both arms. However, in certain circumstances, for example when glazing bars are to be connected to only one side of the glazing material, one arm may be sufficiently short to lie wholly within the confines of the resilient glazing bead or frame member, and therefore remain out of sight.

The use of double glazing is nowadays prevalent, and the present invention is equally applicable to single-glazing, double-glazing or indeed any thickness of glazing material.

The frame members could be formed from any number of types of material, but commonly they may be formed from aluminium or plastics material hollow extrusions or pultrusions.

According to the present invention there is also provided generally U-shaped clips for use with a method as described above. These clips comprise a base adapted to lie against the edge of the glazing material, and two arms extending therefrom which lie respectively against the side faces of the glazing material, wherein at least one of the arms being adapted for engagement with the open end of glazing bars.

These clips may conveniently be formed from metal or plastics material. For ease of connection to a glazing bar it is preferred that the end of the or each arm which is adapted for engagement with the glazing bars is raised from the surface of the glazing material.

According to the present invention there is also provided a glazed panel whenever carrying Georgian-effect glazing bars provided by a method as hereinbefore described.

Such a glazing panel could be an entire window, of any of numerous designs, or might comprise only a portion thereof, or indeed any glazed item such as a door. In effect, the present invention could be applied to any glazed panel whatever its purpose.

The present invention above has been described with reference to the glazing material being located within a frame. It will of course be understood that the reference to frame also encompasses any holder for glass having a glazing rebate for locating that glass.

By way of example only the present invention will now be described with reference to the accompanying drawings in which:

FIG. 2 illustrates a prior art sequence of attaching glazing bars;

FIG. 3 shows the edge of a double glazing sealed unit with a clip according to the present invention attached thereto;

Figure 1:
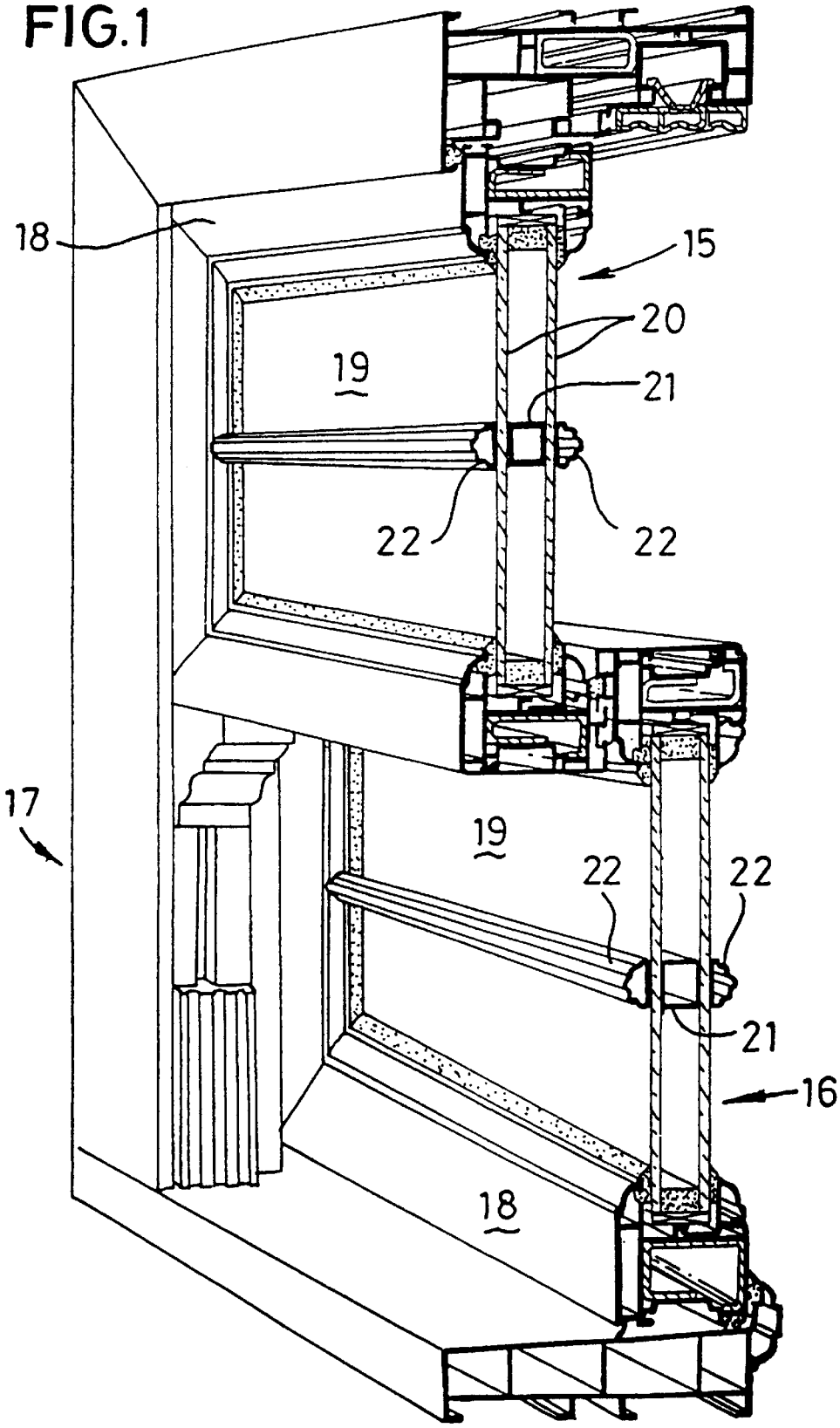
FIG. 1 is a cut away perspective view of a typical embodiment of a prior art window having glazing bars attached thereto with adhesive.

A conventional vertically-sliding sash window having a first sash 15 and a second sash 16 slidably-mounted within an outer frame 17, is shown in FIG. 1. Each sash 15 and 16 comprises a frame 18 that holds a sealed double glazing unit 19. A spacer bar 21 is positioned between the two panes of glass 20. Glazing bars 22 are located on the outer surfaces of the glass overlying the spacer bar 21. These glazing bars have a substantially flat lower surface which is disposed toward the glass 20 and the glazing bars also have a suitably profiled upper surface to give a decorative appearance.

In the prior art these glazing bars 22 are attached to the surface of the glass using adhesive, which as discussed above is prone to degradation. The external surface of the frame 18 is provided with a decoratively profiled fixed bead in the region adjacent the glass. The ends of the glazing bars 22 are cut to match this profile.

Previously, as shown in FIG. 2, when it was desired to construct an arrangement with intersecting glazing bars, a first bar 24 would be connected to the glass and would run continuously from one side to the other (usually vertically). Then, second and subsequent portions 25 of glazing bar would be cut to fit horizontally between the edge of the frame 18 and the first bar 24. Once positioned, these second and subsequent portions 25 in conjunction with the first bar 24 would create the appearance of two continuous bars intersecting at right angles.

In contrast to the attachment with adhesive alone discussed above, the present invention will be described with reference to FIG. 3 onwards, and where possible like reference numerals will be used to describe like parts.

In FIG. 3, the corner region of a sealed glazing unit 30 is shown. The glazing unit 30 comprises first and second panes of glass 31 and 32 separated by thermally-insulating spacers (not shown). A generally U-shaped clip 33 is attached around the edge of the glazing unit 30, said clip comprising a base 34 that lies against the edge of the glazing unit, and first and second arms 35 and 36 extending at right angles from the base 34. The first arm 35 extends over the first pane 31 from the edge thereof, and the second arm 36 extends over the second pane 32, in a similar fashion.

Figure 4:
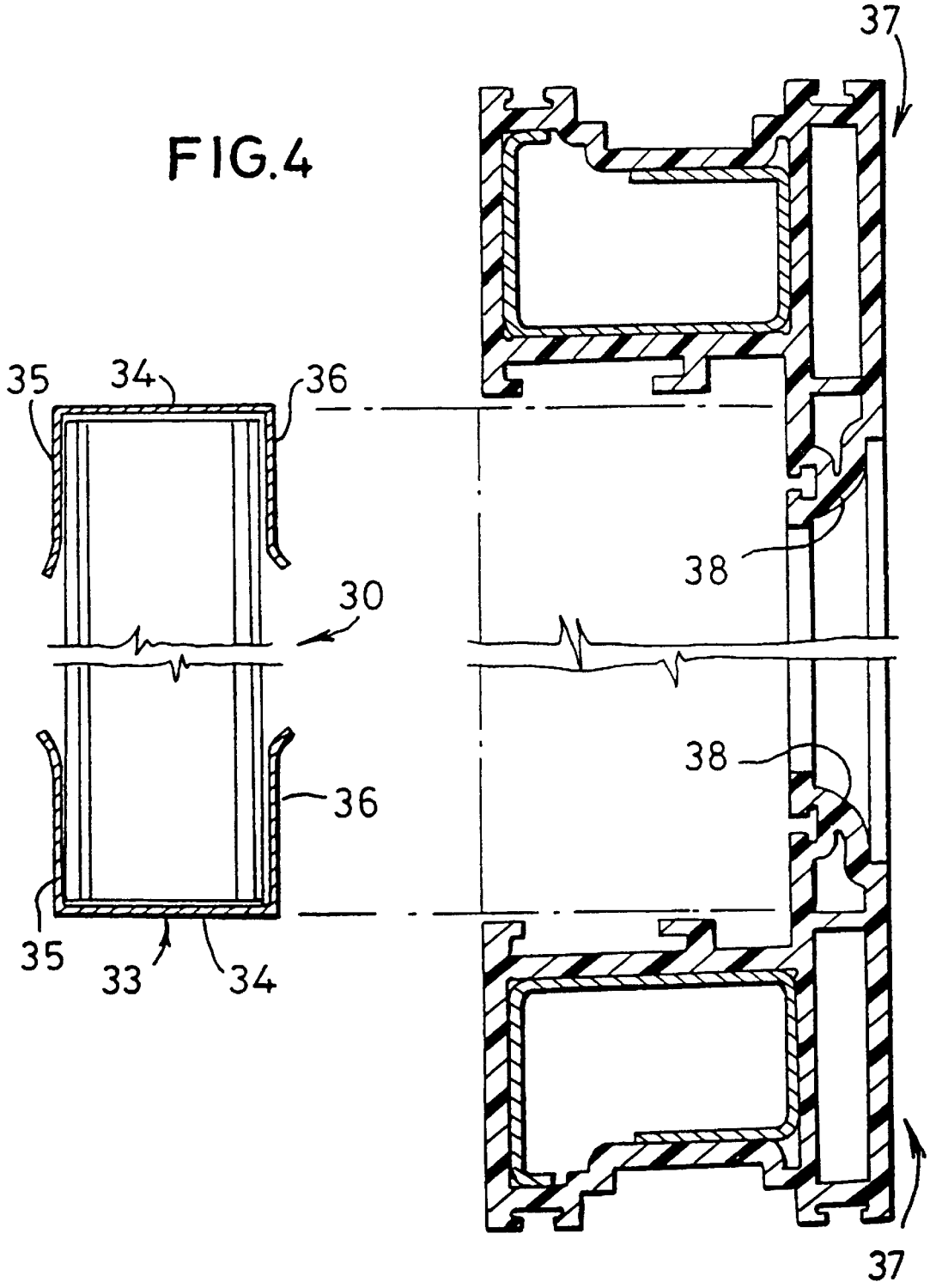
FIG. 4 shows a partial cross-section through a glazing unit and frame according to the present invention.

In FIG. 4, the glazing unit 30 with two clips 33 attached thereto is shown ready for insertion into the glazing rebate of a frame generally indicated 37. The frame 37 is formed from a number of extruded sections that are joined together, for example, by welding. The glazed unit 30 and clips 33 locate within the frame adjacent an inwardly-directed fixed bead 38, with appropriate sealing elements (not shown) disposed therebetween. When the glazed unit and clips are located in the frame, some movement of the clips is possible to allow their correct positioning prior to attachment of the glazing bars.

Figure 5:
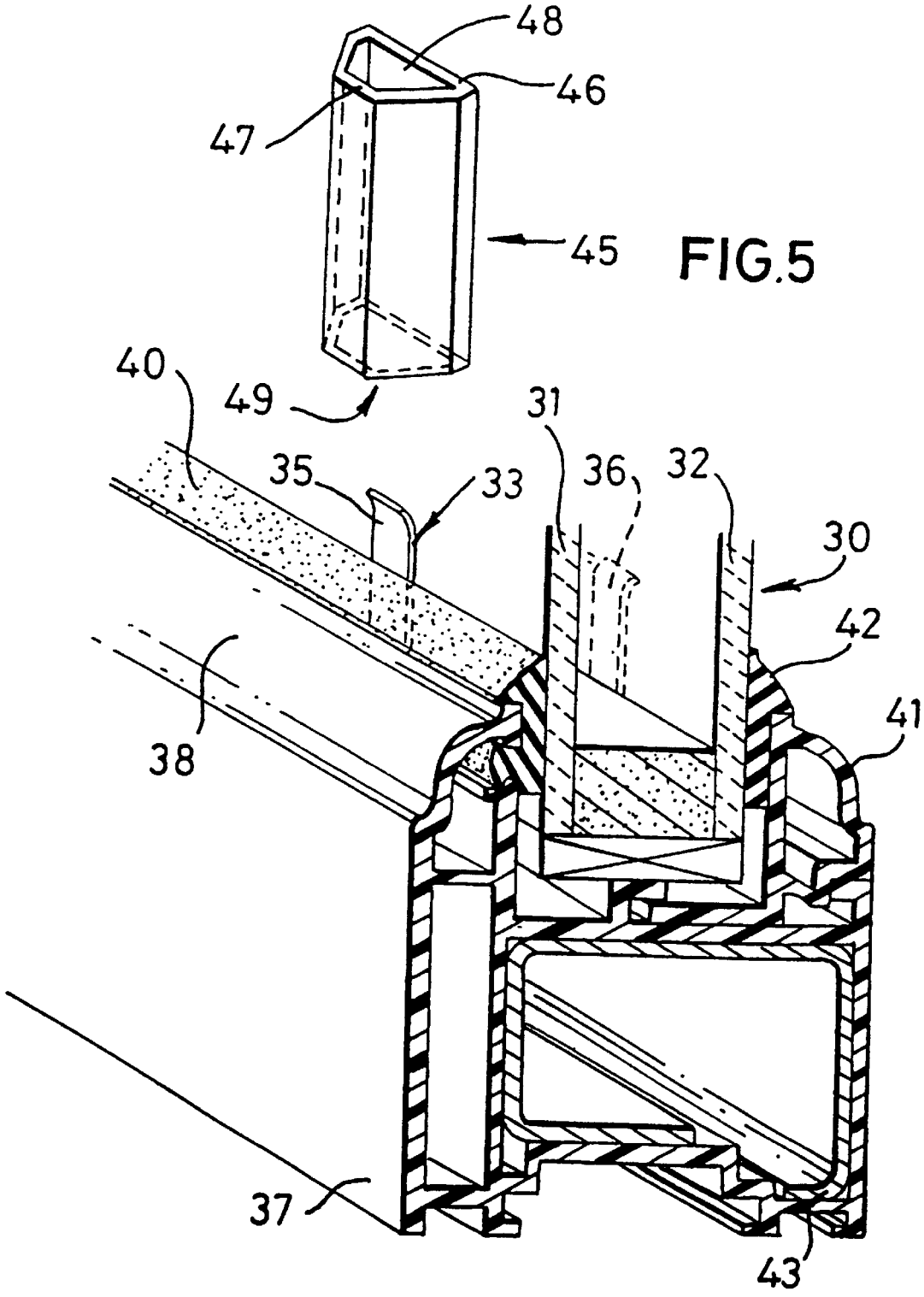
FIG. 5 shows a cut away perspective view of a part of a window constructed according to the present invention.

FIG. 5 shows the next stage of the construction process wherein a glazed unit 30 with a clip 33 connected thereto has been inserted into a frame 37. The first pane 31 abuts a sealing element 40 connected to the fixed bead 38, and a resilient glazing bead 41 has been attached to frame 37 to hold the glazing unit 30 in its correct location. The resilient glazing bead 41 has a second sealing element 42 connected thereto, which second sealing element abuts on the second pane 32 of the glazing unit 30. The frame 37 is provided with a metal reinforcing member 43. The end of the first arm 35 extends beyond the sealing element 40 to protrude over the first pane 31. Similarly, the second arm 36 extends beyond the second sealing element 42 to protrude over the second pane 32. The outermost ends of both arms are curved away from the respective pane to permit connection of the glazing bar thereto.

A glazing bar 45 formed from a length of a hollow extruded section is also shown. The glazing bar 45 comprises a substantially flat lower portion and a profiled upper portion 47, which together define the hollow interior 48. The open end 49 of the glazing bar 45 is cut to mach the shape of the frame at the point where it touches, and in so cutting the bar access to the interior 48 is provided. When fitting the glazing bar 45 to the glazing unit 30, the lower portion 46 is disposed towards the surface of the pane to which the bar is to be attached. The open end 49 is then moved towards either arm of the clip, and the lower portion 46 of the bar is located between the arm and the surface of the glazing unit. The tip of the arm locates within the hollow interior of the bar, and the resilient deformation of the arm leads to the clamping of the bar 45 to the glazing unit 30.

Such arrangements allow the connection of the ends of glazing bars that abut the frame to be held in place. However, as mentioned above, it is important that intersections between perpendicular glazing bars may be formed. To this end, a number of methods of forming such intersections will now be described.

Figure 6:
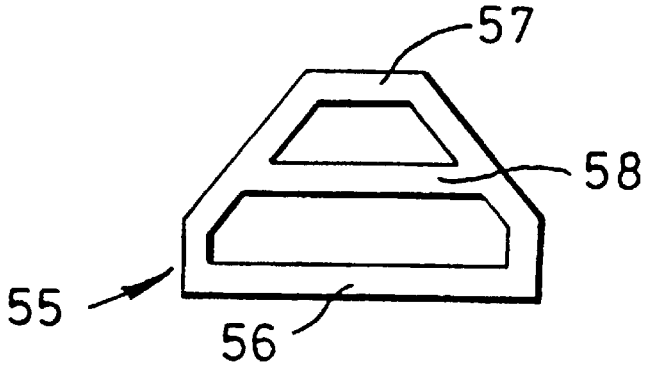
FIG. 6 shows a cross-section of one embodiment of glazing bar.

An alternative embodiment of glazing bar is shown in FIG. 6. In this cross section the glazing bar generally indicated 55 has a lower portion 56 and an upper portion 57. An inner web 58 parallel to the lower portion 56 is also provided. This inner web 58 adds to the structural integrity of the bar and permits the forming of halved joints as hereinafter described.

Figure 7:
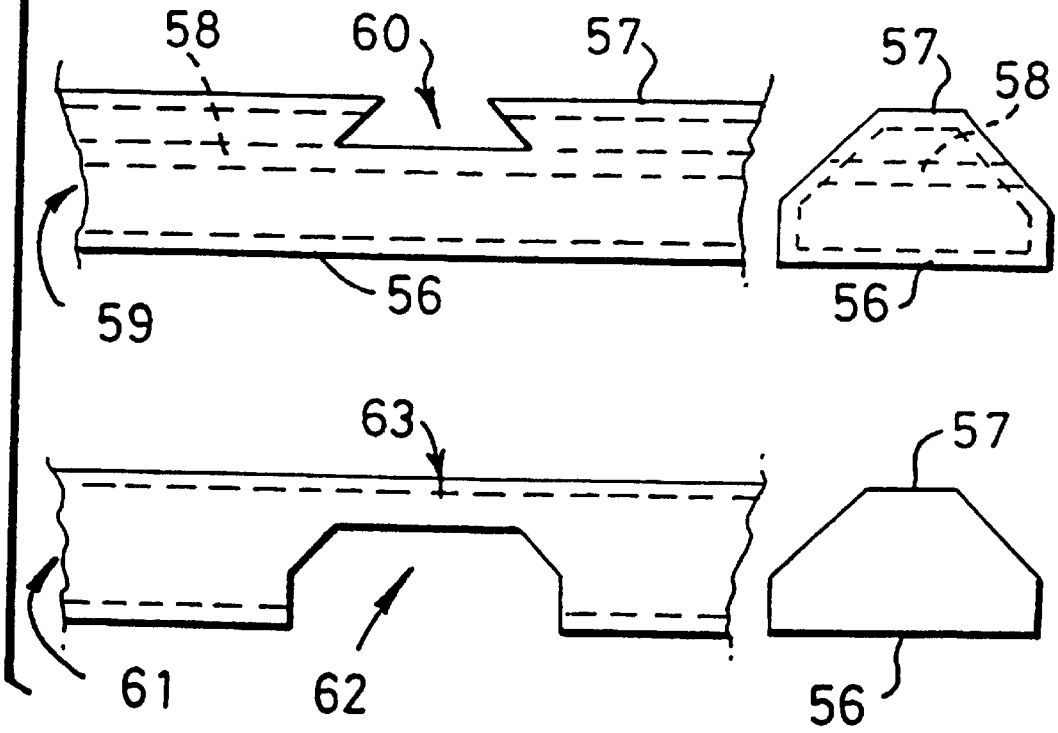
FIG. 7 shows side and end views of two glazing bars (of an embodiment the same as FIG. 6) cut so as to permit the formation of a halved joint.

FIG. 7 shows how an embodiment of glazing bar as shown in FIG. 6 could be cut to allow the formation of a halved joint. The first glazing bar 59 (shown at the top of FIG. 7) has been cut to form a recess 60 that extends down as far as the upper surface of the web portion 58. The structural integrity of this recessed bar is maintained because a tubular structure, comprising the lower portion, the web portion and the remainder of the upper portion remains intact. In the lower half of FIG. 7, a second glazing bar 61 has been cut to form a second recess 62. The remaining portion 63 of the second bar 61 which is left after the second recess 62 has been cut is of a shape suitable to locate within the first recess 60. By locating the remaining portion 63 within the first recess 60, a halving joint may be formed therebetween.

As will be appreciated, the shape of the recess 60 is wider at its base than at its entry point. As such, the remaining portion 63 will not readily locate therein. However, the first glazing bar 59 is sufficiently flexible to allow the bending thereof to widen the entry point of the first recess 60. If the remaining portion 63 of the second bar 61 is inserted into the first recess 60 whilst the first recess is so widened, and the first glazing bar 59 is then allowed to relax and return to its normal orientation, the second glazing bar 61 will be held in place, so resisting separation.

Figure 8:
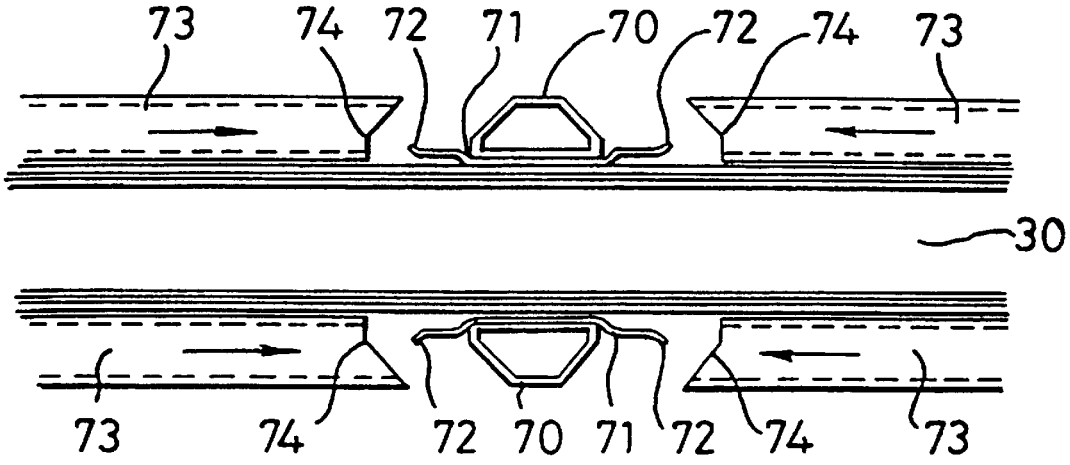
FIG. 8 shows a cross-section through a portion of a glazed unit showing an alternative method of joining the bars at intersections thereof.
Figure 9:
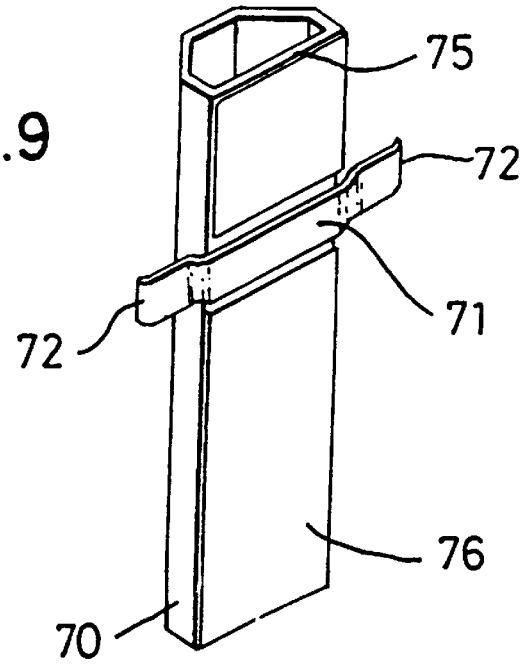
FIG. 9 shows a perspective view of the continuous bar of FIG. 8.

FIGS. 8 and 9 show an alternative method of forming an intersection between perpendicular glazing bars. In this method, one of the glazing bars is continuous and the other is cut into two parts that abut on the external profile of the one glazing bar.

In FIG. 8 a first continuous glazed bar 70 is disposed on the surface of the glazed unit 30. In fact the figure shows matching bars on the other surface of the glazed unit, but only one side will be detailed. The ends of this continuous glazing bar 70 are attached using clips as hereinbefore described but which cannot be seen from this diagram. A bridging connector 71 is disposed between the continuous glazing bar 70 and the one surface of the glazing unit 30. The bridging connector 71 extends laterally from the continuous glazing bar 70 and the outer ends 72 are curved away from the surface of the glazing unit 30.

A second discontinuous glazing bar formed from two halves 73 is provided perpendicular to the continuous glazing bar 70. The open ends 74 of each half 73 are suitably configured to match the external profile of the continuous glazing bar 70. Each half 73 is connected to an outer end 72 of the bridging connector 71. This is achieved by inserting the lower portion 75 of each half beneath the upturned outer end and allowing the resilience of the bridging connector in a similar way to connection to the clip.

FIG. 9 shows the bridging connector 71 against the lower portion 75 of the continuous bar 70. The lower surface of the lower portion 75 is provided with a strip of double sided adhesive tape 76, which has been removed at the region where the bridging connector 71 abuts the continuous bar 70.

When glazing bars intersect in either of the ways described above, the ends of the bars adjacent the frame are connected using the clips. Where a complex arrangement of glazing bars is formed, it is possible that some bars may extend between two perpendicular bars and therefore not but on the frame at any point. However, as long as these bars are properly connected at the intersections at their ends, they will still be mechanically held against the glass.

Whilst the attachment methods according to the present invention could be used to connect glazing bars to a window without additional means, they are primarily intended for use in combination with conventional connection means such as adhesive. If a combination of these are used, even if the adhesive fails, the bars will remain connected to the window due to the connection provided by the present invention.

A typical window constructed by methods according to this invention could be made in the following way. Firstly, a glazing unit having between the panes of glass, spacer bars in a pattern corresponding to a desired final arrangement of glazing bars is provided. Clips are provided on the edge of the glazing unit at points approximately corresponding to the ends of the spacer bars. The glazing unit and clips are then inserted into the frame element and are held in place by connection of a resilient glazing bead connectable to the frame. The clip are then positioned more carefully into the correct locations. Glazing bars having suitably profiled ends are then connected to the arms of the clips by wedging a portion of each end of the bar between the glazed unit and the arm of an opposed pair of clips. In addition, the surface of the glazing bars which contacts the glazing unit is provided with adhesive covered by a backing sheet. By flexing the glazing bars now connected to a pair of clips, sufficient space between the bar and the glazing unit may be achieved to allow the removal of the backing sheet. Subsequent relaxation of the glazing bar or pressure thereon allows contact and thus adhesion of the bar to the glazing unit. In a complex arrangement of intersecting glazing bars, suitable means of permitting intersection as hereinbefore described are provided.

What is claimed is:

1. A method of furnishing a glazed panel with at least one Georgian-effect glazing bar, which method comprises the steps of:

providing a frame for the panel and glazing material to fit within the frame;

arranging a generally U-shaped clip to extend around an edge of the glazing material, the clip having two arms which lie respectively against the side faces of the glazing material;

cutting a suitable length of moulded hollow-section glazing bar for extending across a side face of the glazing material, from one frame member to an opposed frame member; and engaging an arm of the clip in an open end of the glazing bar, to hold the end region of the glazing bar against the side face of the glazing material.

2. A method as claimed in claim 1, wherein a second clip is arranged around an opposed edge of the glazing material, the glazing bar extending between the two clips with the respective arms of the two clips engaged in the two open ends of the glazing bar.

3. A method as claimed in claim 1, wherein the glazing bar has a substantially flat face adapted to lie against the glazing material, the substantially flat face being adhered to the underlying glazing material.

4. A method as claimed in claim 3, wherein the substantially flat face of the glazing bar caries a length of double-sided adhesive tape having an exposed backing sheet, which backing sheet is stripped to expose the adhesive immediately before the glazing bar is fitted to the glazing material.

5. A method as claimed in claim 3, wherein the glazing bar is fitted to the arms of the clip or clips before then being adhere to the glazing material.

6. A method as claimed in claim 1, wherein a glazing bar having a horizontal web splitting the interior into two chambers is used.

7. A method as claimed claim 1, wherein more than one glazing bar is fitted to the glazing material.

8. A method as claimed claim 7, wherein a matrix of glazing bars is secured to the glazing material, the bars intersecting substantially at right angles.

9. A method as claimed in claim 8, wherein a halved joint is formed at each intersection between the glazing bars.

10. A method as claimed in claim 8, wherein at the or each intersection of two glazing bars, one glazing bar is continuous, and the other glazing bar is discontinuous but attached to the one glazing bar.

11. A method as claimed in claim 10, wherein the discontinuous glazing bar is attached by means of a bridging connector that passes through or under the one glazing bar.

12. A method as claimed in claim 11, wherein the bridging connector is configured to extend laterally with respect to the one glazing bar, and the extended portions of the bridging connector locate in open ends of the discontinuous other glazing bar.

13. A method as claimed in claim 1, wherein a resilient glazing bead is used to hold the glazing material in the frame, and the end portion of the or each glazing bar overlaps the external surface of the glazing bead and is cut to match the external profile thereof.

14. A method as claimed in claim 1, wherein a glazing bar is fitted to only one arm of the or each clip, the other arm being sufficiently short to lie wholly within the confines of the resilient glazing bead or frame member.

15. A method as claimed in claim 1, wherein glazing bars are fitted to both sides of the glazing material, in alignment with each other.

16. A method as claimed in claim 1, wherein the glazing material comprises a sealed double glazing unit.

17. A method as claimed in claim 1, wherein the frame is made from aluminium or plastics material hollow extrusions.

18. A glazed panel whenever carrying Georgian-effect glazing bars attached by a method according to claim 1.

19. A glazed panel as claimed in claim 18, which comprises one sash panel of a vertically sliding sash window.

20. A generally U-shaped clip for use in a method according to claim 1, comprising a base adapted to lie against the edge of the glazing material, and two arms extending therefrom which lie respectively against the side faces of the glazing material, wherein at least one of the arms is adapted for engagement with an open end of the glazing bar.

21. A generally U-shaped clip as claimed in claim 20, wherein the end of the or each arm adapted for engagement with the glazing bars is raised from the surface of the glazing material to ease connection of a glazing bar.

* * * * *